US010074895B2

(12) United States Patent
Sugimoto et al.

(10) Patent No.: US 10,074,895 B2
(45) Date of Patent: Sep. 11, 2018

(54) COLLECTIVE ANTENNA DEVICE

(71) Applicants: DENSO CORPORATION, Kariya, Aichi-pref. (JP); NIPPON SOKEN, INC., Nishio, Aichi-pref. (JP)

(72) Inventors: Yuji Sugimoto, Nishio (JP); Tadao Suzuki, Kariya (JP)

(73) Assignees: DENSO CORPORATION, Kariya, Aichi-pref. (JP); SOKEN, INC., Nishio, Aichi-pref. (JP)

( * ) Notice: Subject to any disclaimer, the term of this patent is extended or adjusted under 35 U.S.C. 154(b) by 30 days.

(21) Appl. No.: 15/119,570

(22) PCT Filed: Feb. 4, 2015

(86) PCT No.: PCT/JP2015/000492
§ 371 (c)(1),
(2) Date: Aug. 17, 2016

(87) PCT Pub. No.: WO2015/125426
PCT Pub. Date: Aug. 27, 2015

(65) Prior Publication Data

US 2017/0077594 A1 Mar. 16, 2017

(30) Foreign Application Priority Data

Feb. 21, 2014 (JP) ..... 2014-031955

(51) Int. Cl.
*H01Q 1/32* (2006.01)
*H01Q 1/42* (2006.01)
(Continued)

(52) U.S. Cl.
CPC ..... *H01Q 1/3275* (2013.01); *H01Q 1/42* (2013.01); *H01Q 1/48* (2013.01); *H01Q 13/06* (2013.01); *H01Q 15/14* (2013.01); *H01Q 21/30* (2013.01)

(58) Field of Classification Search
CPC ..... H01Q 1/3275; H01Q 1/42; H01Q 1/48; H01Q 15/14; H01Q 21/30
(Continued)

(56) References Cited

U.S. PATENT DOCUMENTS 4,749,998 A * 6/1988 Yotsuya ..... H01Q 1/1271 343/712
5,610,620 A * 3/1997 Stites ..... H01Q 1/28 343/700 MS
(Continued)

FOREIGN PATENT DOCUMENTS

GB 2504413 A * 1/2014 ..... H01Q 1/3275
JP H08242117 A 9/1996
(Continued)

*Primary Examiner* — Dameon E Levi
*Assistant Examiner* — Ab Salam Alkassim, Jr.
(74) *Attorney, Agent, or Firm* — Harness, Dickey & Pierce, P.L.C.

(57) ABSTRACT

A collective antenna device includes: a case having a gradually rising part in which spatial height increases continuously toward a rear part; a ground plate that is accommodated at a bottom part of the case; a first antenna element that is accommodated in the case and configured for a first frequency; and a second antenna element that is accommodated in the case and configured for a second frequency higher than the first frequency. The second element is accommodated in the case such that the second antenna element is located below or behind the gradually rising part and also located behind the first antenna element. A feed point of the second antenna element is located above the ground plate.

9 Claims, 5 Drawing Sheets

(51) Int. Cl.

| | |
|---|---|
| ***H01Q 21/30*** | (2006.01) |
| ***H01Q 1/48*** | (2006.01) |
| ***H01Q 13/06*** | (2006.01) |
| ***H01Q 15/14*** | (2006.01) |

(58) Field of Classification Search
USPC ..... 343/713
See application file for complete search history.

(56) References Cited

U.S. PATENT DOCUMENTS 5,701,128 A * 12/1997 Okada ..... H01Q 1/243 343/700 MS
6,172,651 B1 * 1/2001 Du ..... H01Q 1/125 333/109
7,106,256 B2 * 9/2006 Watanabe ..... H01Q 1/1271 343/700 MS
8,816,917 B2 * 8/2014 Ueno ..... H01Q 1/3275 343/713
8,947,307 B2 * 2/2015 Lo ..... H01Q 1/3275 343/711
9,608,316 B2 * 3/2017 Choi ..... H01Q 1/3275
9,831,545 B2 * 11/2017 Sugimoto ..... H01Q 1/48
9,837,715 B2 * 12/2017 Sugimoto ..... H01Q 5/30
2002/0171593 A1 * 11/2002 Wakui ..... H01Q 1/243 343/702
2003/0076264 A1 * 4/2003 Yuanzhu ..... H01Q 1/38 343/700 MS
2005/0062658 A1 * 3/2005 Magg ..... H01Q 1/1214 343/711
2005/0219131 A1 * 10/2005 Haidacher ..... H01Q 1/3275 343/725
2006/0077112 A1 * 4/2006 Nakano ..... H01Q 1/1242 343/715
2007/0171138 A1 * 7/2007 Noro ..... H01Q 1/3275 343/713
2007/0241973 A1 * 10/2007 Cho ..... H01Q 1/3275 343/713
2008/0198077 A1 * 8/2008 Duzdar ..... H01Q 21/30 343/715
2008/0272969 A1 * 11/2008 Tengler ..... H01Q 1/088 343/715
2009/0207084 A1 * 8/2009 Ikeda ..... H01Q 1/1207 343/713
2009/0221243 A1 * 9/2009 Egawa ..... H01Q 9/16 455/90.3
2010/0013724 A1 * 1/2010 Ohshima ..... H01Q 1/3275 343/713
2010/0136936 A1 * 6/2010 Jiang ..... H01Q 1/3275 455/143
2010/0265147 A1 * 10/2010 Wakui ..... H01Q 1/3275 343/725
2010/0277379 A1 * 11/2010 Lindackers ..... H01Q 1/1207 343/713
2011/0043420 A1 * 2/2011 Tateno ..... H01Q 1/1207 343/725
2011/0221640 A1 * 9/2011 Huber ..... H01Q 1/1214 343/713
2012/0001811 A1 * 1/2012 Yoo ..... H01Q 1/3275 343/713
2012/0081253 A1 * 4/2012 Duzdar ..... H01Q 21/28 343/713
2012/0274519 A1 * 11/2012 Chakam ..... H01Q 1/3275 343/702
2013/0141297 A1 * 6/2013 Gomme ..... H01Q 5/35 343/770
2014/0292593 A1 * 10/2014 Thiam ..... H01Q 1/3275 343/713
2014/0340267 A1 * 11/2014 Kim ..... H01Q 1/3275 343/713
2015/0061964 A1 * 3/2015 Sugimoto ..... H01Q 9/42 343/893
2015/0077305 A1 * 3/2015 Sugimoto ..... H01Q 9/30 343/848
2015/0097738 A1 * 4/2015 Sugimoto ..... H01Q 1/3275 343/702
2015/0229020 A1 * 8/2015 Sugimoto ..... H01Q 1/3275 343/702
2015/0229021 A1 * 8/2015 Yukizaki ..... H01Q 1/3275 343/702
2015/0229500 A1 * 8/2015 Suzuki ..... H04B 7/0617 375/219
2015/0236404 A1 * 8/2015 Choi ..... H01Q 5/10 343/722
2016/0064807 A1 * 3/2016 Reed ..... H01Q 1/3275 343/713
2016/0285175 A1 * 9/2016 Juan ..... H01Q 21/26
2017/0054204 A1 * 2/2017 Changalvala ..... H01Q 1/3291
2017/0093026 A1 * 3/2017 Anderson ..... H01Q 1/2291
2017/0136959 A1 * 5/2017 Denny ..... B60R 11/0205
2018/0019512 A1 * 1/2018 Ortigosa ..... H01Q 1/1214

FOREIGN PATENT DOCUMENTS

| | | | |
|---|---|---|---|
| JP | 3059388 | U | 7/1999 |
| JP | 2006238029 | A | 9/2006 |
| JP | 4260186 | B2 | 4/2009 |
| JP | 2013223023 | A | 10/2013 |
| WO | WO-2012127734 | A1 | 9/2012 |

* cited by examiner

DIRECTIVITY OF SHORT-RANGE COMMUNICATION ANTENNA ELEMENT

| | DISTAL END POSITION OF MOBILE NETWORK ANTENNA ELEMENT | |
|---|---|---|
| | HIGHER THAN FEEDING POSITION OF SHORT-RANGE COMMUNICATION ANTENNA ELEMENT (FIRST EMBODIMENT) | LOWER THAN FEEDING POSITION OF SHORT-RANGE COMMUNICATION ANTENNA ELEMENT (SECOND EMBODIMENT) |
| HORIZONTAL PLANE | -1.5dBi  | +2.9dB → 1.4dBi  |

COLLECTIVE ANTENNA DEVICE

CROSS REFERENCE TO RELATED APPLICATIONS

This application is a U.S. National Phase Application under 35 U.S.C. 371 of International Application No. PCT/JP2015/000492 filed on Feb. 4, 2015 and published in Japanese as WO 2015/125426 A1 on Aug. 27, 2015. This application is based on and claims the benefit of priority from Japanese Patent Application No. 2014-031955 filed on Feb. 21, 2014. The entire disclosures of all of the above applications are incorporated herein by reference.

TECHNICAL FIELD

The present disclosure relates to a collective antenna device that has a plurality of antenna elements housed in one case.

BACKGROUND ART

As a collective antenna device that has a plurality of antenna elements housed in one case, one that is described in Patent Literature 1 is known. The device disclosed in Patent Literature 1 encases an antenna used for automotive wireless communication, and antennas for receiving high-frequency signals used in satellite digital audio radio service (SDARS) inside a housing. There are two antennas for SDARS, one being the antenna for receiving radio waves emitted from a satellite, and the other being an antenna for receiving terrestrial radio waves transmitted from a ground relay station.

The automotive wireless communication envisioned here uses either 900 MHz or 1.8 GHz frequency band, while SDARS uses 2.3 GHz frequency band. Therefore, the antenna for the automotive wireless communication is longer than the antennas for SDARS.

The device disclosed in Patent Literature 1 is attached to a rear part of the roof of a car. The case is formed such that its internal spatial height continuously increases from the front end to a point close to the rear end so as to reduce air resistance. Due to this shape, the internal spatial height of the case is relatively greater in the rear part.

In Patent Literature 1, this internal spatial height in the rear part is used to accommodate the antenna for the automotive wireless communication that is relatively longer due to the relatively lower frequency band.

However, most cars have a roof that is highest in the middle in the front-back direction and inclined from the peak toward the rear end of the roof. Since the collective antenna device is commonly installed in the rear part of the car roof, the radio waves emitted from the collective antenna device at low elevation angles in the forward direction of the vehicle are blocked by the inclination of the roof from near its center toward the rear end. The higher the frequency, the more straight, the radio waves travel. Thus, the higher the frequency of emitted radio waves, the more the radiation at low elevation angles in the forward direction of the vehicle is reduced.

Therefore, when the roof has such a shape, the technical issue encountered by the device of Patent Literature 1 was that the power gain of each antenna in the collective antenna device was reduced, in particular, the power gain in the forward direction of the antenna for relatively high-frequency terrestrial radio waves of SDARS would drop largely, because of which the radiation level of the antenna was low.

The technical issue of reduced power gain in the forward direction of an antenna that emits radio waves at relatively high frequencies arises not necessarily with antennas used in automotive wireless communication or SDARS but when there is an inclined configuration that blocks radiation in front of a collective antenna device that includes a plurality of antennas emitting radio waves of mutually different frequencies such as a mobile network antenna and an antenna used for vehicle-to-vehicle communication or road-to-vehicle communication.

PRIOR ART LITERATURES

Patent Literature

Patent Literature 1: JP 4260186 B2

SUMMARY OF INVENTION

It is an object of the present disclosure to provide a collective antenna device that includes a first antenna element configured for a first frequency, and a second antenna element configured for a second frequency that is higher than the first frequency, the second antenna element having a better power gain in the forward direction.

A collective antenna device according to an aspect in the present disclosure includes: a case including a gradually rising part in which spatial height increases continuously toward a rear part; a ground plate that is accommodated in a bottom part of the case; a first antenna element that is accommodated in the case and configured for a first frequency; and a second antenna element that is accommodated in the case and configured for a second frequency higher than the first frequency. The second antenna element is accommodated at the gradually rising part or behind the gradually rising part in the case as well as behind the first antenna element in the case, and the second antenna element has a feed point located above the ground plate.

In the collective antenna device, the second antenna element is arranged at the gradually rising part or behind the gradually rising part in the case, as well as behind the first antenna element in the case. In this position, the case has a greater internal spatial height than in the position where the first antenna element is accommodated. With this height, the power gain in the forward direction of the second antenna element, when the collective antenna device is arranged in a location with an inclined configuration that blocks the radiation in the forward direction, can be increased.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION (First Embodiment)

Figure 1:
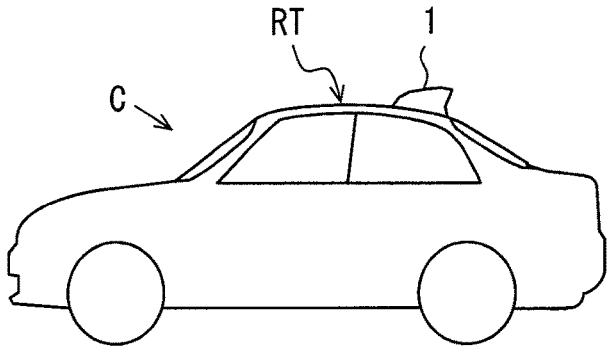
FIG. 1 is a diagram showing a fixed position of a collective antenna device of a first embodiment.

Hereinafter, embodiments of the present disclosure will be described with reference to the drawings. As shown in FIG. 1, a collective antenna device 1 of the first embodiment is fixed to a rear end part of the roof of a vehicle C. The roof of this vehicle C is inclined downward from a roof top RT toward the rear end. Therefore, the collective antenna device 1 fixed to the rear end of the roof is oriented such that its rear side is below the front side. The part where the collective antenna device 1 is fixed is positioned below the roof top RT.

The vehicle C of FIG. 1 is one example. The collective antenna device 1 can be attached to various types of cars. The height of the rear end of the collective antenna device 1 with respect to its front end varies depending on the inclination of the roof of the car to which the antenna is attached.

Figure 2:
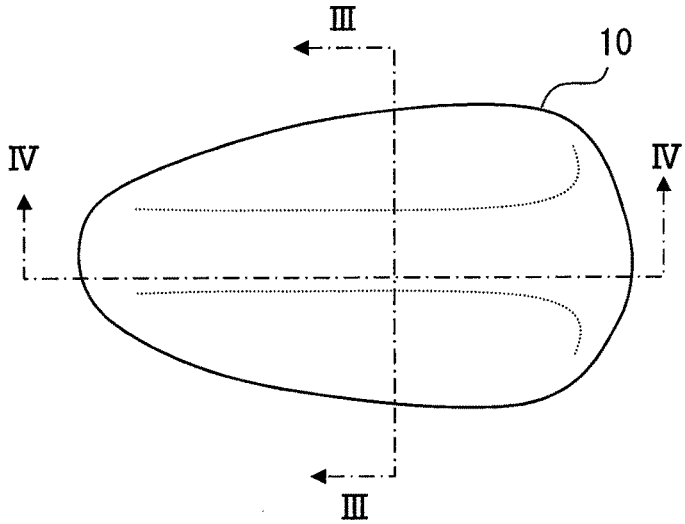
FIG. 2 is a top plan view of a case of the collective antenna device.

The collective antenna device 1 has an outer shape similar to that of a shark's or dolphin's fin. Because of its outer shape, this collective antenna device 1 is referred to as "shark antenna" or "dolphin antenna". As shown in FIG. 2, the case 10 of the collective antenna device 1 has a streamline shape in top plan view. The length in a vehicle widthwise direction is somewhat shorter on the front side of the vehicle than on the rear side. The length in a vehicle front-back direction of the case 10 is longer than the length in the vehicle widthwise direction. The case 10 is made of resin.

Figure 3:
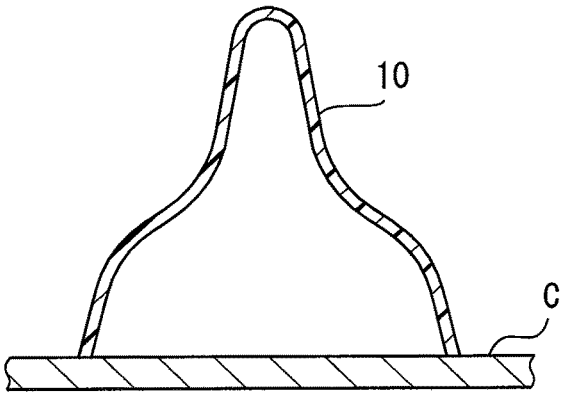
FIG. 3 is a cross-sectional view along line III-III of FIG. 2.

As shown in FIG. 3, the length in the vehicle widthwise direction of the case 10 is shorter on the upper side than on the bottom side. The case 10 is open at the bottom. Since FIG. 3 is a diagram for explaining the shape of the case 10, the components accommodated inside the case 10 are not shown.

Figure 4:
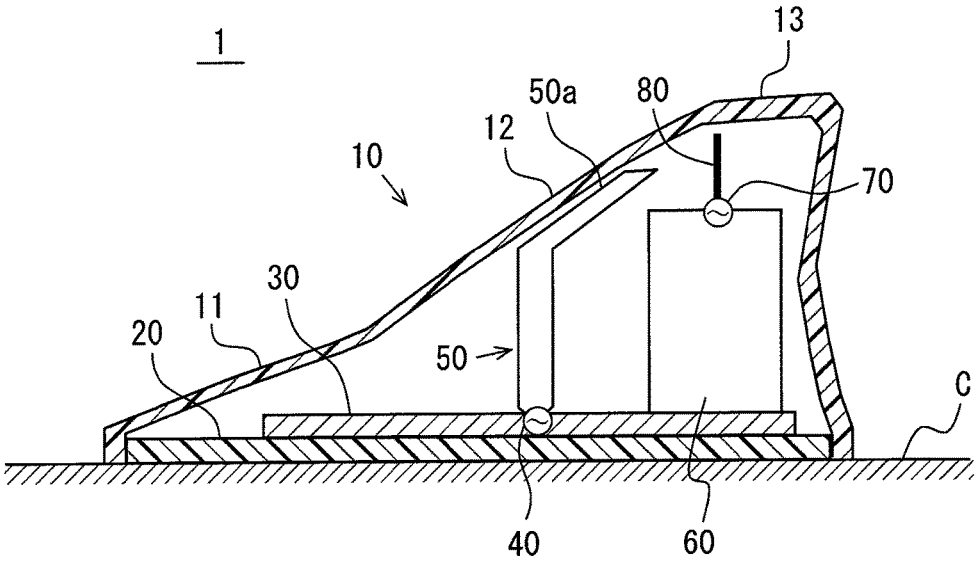
FIG. 4 is a cross-sectional view along line IV-IV of FIG. 2.

As shown in FIG. 4, the case 10 includes a first gradually rising part 11, a second gradually rising part 12, and a rear part 13. The first gradually rising part 11 is gently inclined from the distal end so that the height of the internal space increases. The second gradually rising part 12 is formed continuously with the first gradually rising part 11 and inclined more steeply than the first gradually rising part 11 so that the closer to the rear part 13, the greater the height of the internal space. The rear part 13 is formed continuously with this second gradually rising part 12. The rear part 13 has a substantially constant internal spatial height.

A planar bottom plate 20 is arranged at the opening of the case 10 to close the opening. The material of the bottom plate 20 is resin, for example. A ground plate 30 is secured on this bottom plate 20. The ground plate 30 is a flat plate made of metal, for example, having a rectangular planar shape, for example.

A feed point 40 is provided substantially at the center of the ground plate 30 in the vehicle front-back direction below the second gradually rising part 12. A base end of a mobile network antenna element 50, which corresponds to a first antenna element, is connected to this feed point 40. A mobile network antenna that includes the mobile network antenna element 50 and the ground plate 30 is a monopole antenna. The mobile network antenna element 50 is arranged substantially perpendicularly to the ground plate 30 to transmit and receive vertically polarized radio waves.

The transmitting and receiving frequency of the mobile network antenna element 50, i.e., a first frequency, is one of 700 MHz band, 800 MHz band, and 900 MHz band, for example. The physical length of the mobile network antenna element 50 is determined by this frequency. This physical length is longer than the internal spatial height of the second gradually rising part 12. Therefore, the distal end 50*a* of the mobile network antenna element 50 is inclined toward the rear part 13 of the case 10 along the slope in the widthwise center of the inner circumferential surface of the second gradually rising part 12.

In a rear part of the ground plate 30 in the vehicle front-back direction is fixed a quadrate planar substrate 60 substantially perpendicularly to the ground plate 30. A ground pattern (not shown) is formed by copper foil or the like on the substrate 60. This ground pattern is connected to the ground plate 30.

A feed point 70 is provided at an upper end of the substrate 60. Therefore, this feed point 70 is positioned above the ground plate 30. The feed point 70 is positioned 50 mm above the ground plate 30, for example.

A base end of a short-range communication antenna element 80, which corresponds to a second antenna element, is connected to the feed point 70. The short-range communication antenna element 80 is an antenna element used in V2X communication technology, i.e., vehicle-to-vehicle or road-to-vehicle communications. The transmitting and receiving frequency of this antenna element, i.e., a second frequency, is 5.9 GHz band, for example. The antenna having this short-range communication antenna element 80 and the ground pattern formed on the substrate 60 is a monopole antenna. The short-range communication antenna element 80 is formed straight unlike the mobile network antenna element 50.

The short-range communication antenna element 80 accommodated in the case 10 is positioned in the rear part 13 of the case 10, and positioned behind the mobile network antenna element 50 accommodated in the second gradually rising part 12 of the case 10. The short-range communication antenna element 80 is oriented generally perpendicularly to the upper side of the substrate 60 and the surface of the ground plate 30 so as to transmit and receive vertically polarized radio waves.

The feed point 70 mentioned above is positioned below the distal end of the mobile network antenna element 50. However, the distal end of the short-range communication antenna element 80 is positioned at a height higher than the distal end of the mobile network antenna element 50.

When the collective antenna device 1 thus configured is attached to a rear end part of the vehicle C having a roof that is inclined downward from the roof top RT toward the rear end as shown in FIG. 1, radio waves emitted toward the front of the vehicle C are partly blocked by the roof inclined from the roof top RT toward the rear end. Therefore, the power gain at low elevation angles in the forward direction is lower than when there is no such inclination. The higher the frequency, the more straight, the radio waves travel. Thus, the higher the frequency of the radio waves the antenna element transmits, the more the power gain at low elevation angles in the forward direction is reduced. Therefore, in this embodiment, the gain reduction in the radiation pattern of the short-range communication antenna element 80 is greater than that in the radiation pattern of the mobile network antenna element 50.

The further lower the antenna element is positioned than the roof top RT, the greater the power gain reduction. Therefore, if the feed point 70 of the short-range communication antenna element 80 is provided on the ground plate 30 so that the base end of the short-range communication antenna element 80 is positioned at the height of the ground plate 30, the power gain of the short-range communication antenna element 80 would be lowered even more.

However, in this embodiment, the short-range communication antenna element 80 is accommodated in the rear part 13 of the case 10. In this accommodation position, the case 10 has a greater internal spatial height than in the position where the mobile network antenna element 50 is accommodated. The feed point 70 of the short-range communication antenna element 80 is positioned above the ground plate 30 by making use of this height. Thus, even though the collective antenna device 1 is arranged in a location with an inclined configuration that blocks the radiation in the front as shown in FIG. 1, the short-range communication antenna element 80 has a favorable radiation pattern in the forward direction.

According to this embodiment, the mobile network antenna element 50 is inclined backward along the inclination of the second gradually rising part 12, so that the mobile network antenna element 50 can be arranged inside the second gradually rising part 12 even though the mobile network antenna element 50 is longer than the internal spatial height of the second gradually rising part 12.

(Second Embodiment)

Figure 5:
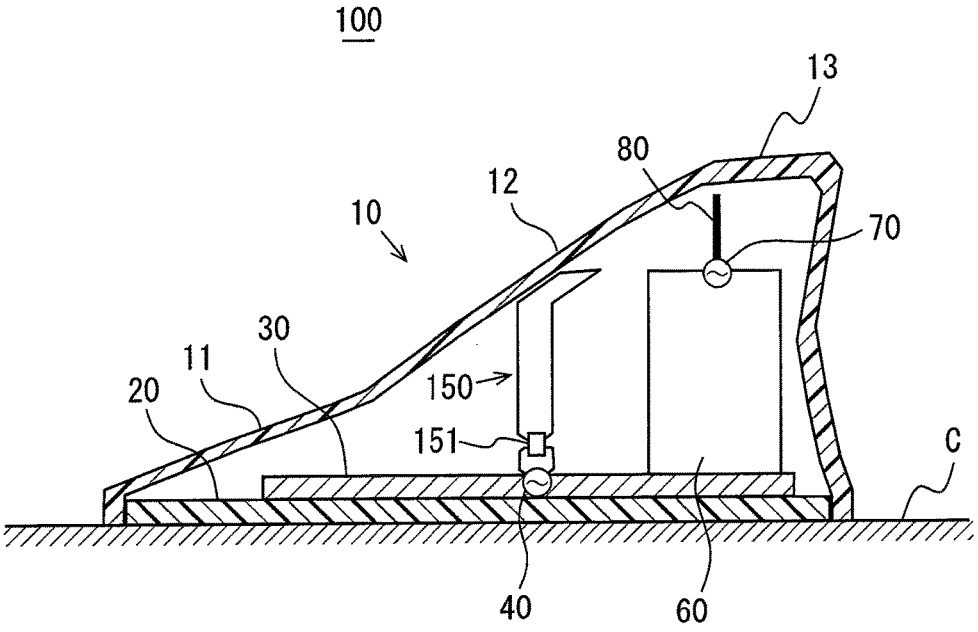
FIG. 5 is a cross-sectional view of a collective antenna device of a second embodiment.

Next, a second embodiment will be described with reference to FIG. 5. In the descriptions of the second embodiment onward, the elements having the same reference numerals as those that have been used are, unless otherwise specified, the same as the elements with the same numerals in the previous embodiment. When only some parts of the configuration are explained, the previously described embodiment can be applied to other parts of the configuration.

The mobile network antenna element 150 equipped in the collective antenna device 100 of the second embodiment includes a matching circuit 151 connected thereto. This mobile network antenna element 150 transmits and receives radio waves of the same frequency band as that of the mobile network antenna element 50 of the first embodiment. In this embodiment, however, since the matching circuit 151 is connected, the mobile network antenna element 150 of the second embodiment has a shorter physical length than the mobile network antenna element 50 of the first embodiment.

More specifically, the matching circuit 151 is adjusted so that the distal end of the mobile network antenna element 150 is positioned substantially at the same height as the feed point 70. Since the distal end of the mobile network antenna element 150 is positioned substantially at the same height as the feed point 70, the distal end of the mobile network antenna element 150 is not at a height higher than the feed point 70.

Figure 6:
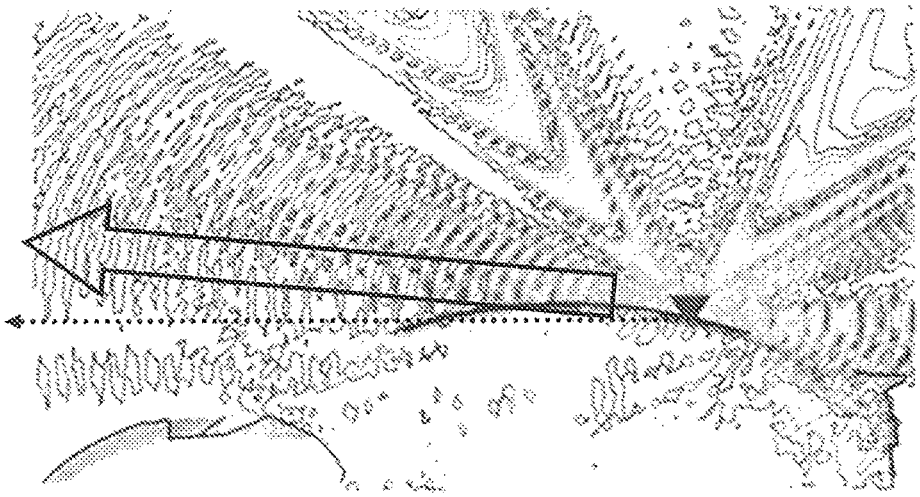
FIG. 6 is a diagram showing the Eθ component of simulated radiated electric field intensity where a short-range communication antenna element is a transmission source.
Figure 7:
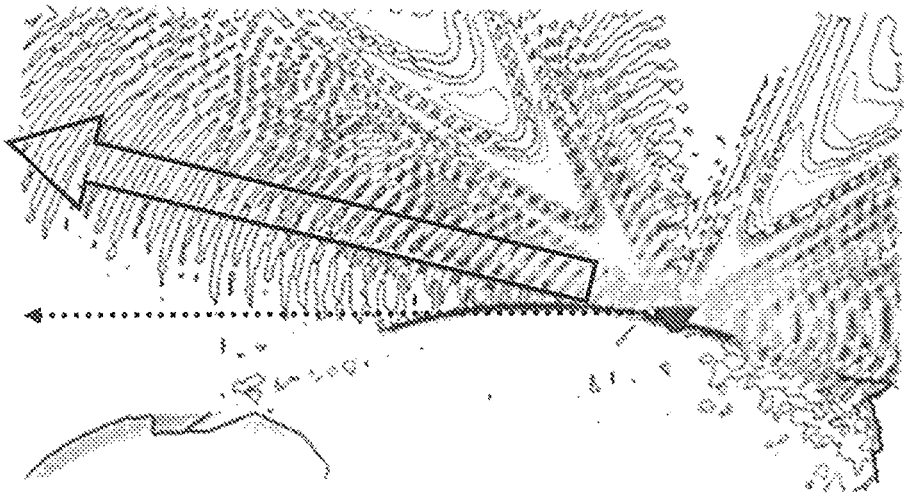
FIG. 7 is a diagram given for comparison with FIG. 6, showing the Eθ component of simulated radiated electric field intensity where the short-range communication antenna element is set on a ground plate.

FIG. 6 is a diagram showing the Eθ component of simulated radiated electric field intensity where the short-range communication antenna element 80 in the collective antenna device 100 of the second embodiment is the transmission source. FIG. 7 is a diagram that shows, in comparison, the Eθ component of simulated radiated electric field intensity of the short-range communication antenna element 80 when the short-range communication antenna element 80 is arranged at the position of the mobile network antenna element 150.

In FIG. 6 and FIG. 7, the downward triangle indicates the position of the collective antenna device on the roof of the vehicle. In both FIG. 6 and FIG. 7, the downward triangle is positioned in the rear of the roof top and is below the roof top. The broken line arrow indicates a horizontal forward direction.

As can be seen from a comparison between the directions of the block arrows in FIG. 6 and FIG. 7, the collective antenna device 100 of the second embodiment has a higher electric field intensity in low-elevation-angle directions in the front of the vehicle (left side of the drawing) than the collective antenna device of the comparative example. This indicates that the collective antenna device 100 of the second embodiment has a better radiation pattern in the forward direction as compared to a case where the short-range communication antenna element 80 is set on the ground plate 30.

In particular, the radiation pattern in the forward direction of the short-range communication antenna element 80 is further improved by disposing the mobile network antenna element 150 such that its distal end is not positioned at a height higher than the feed point 70 of the short-range communication antenna element 80 as in the second embodiment, as compared to a case where the distal end of the mobile network antenna element 50 is at a height higher than the feed point 70 of the short-range communication antenna element 80 as in the first embodiment.

Since the feed point 70 is positioned at substantially the same height as the distal end of the mobile network antenna element 150 in the second embodiment, the short-range communication antenna element 80 is entirely positioned at a height higher than the distal end of the mobile network antenna element 150. Therefore, coupling with the mobile network antenna element 150 located in the front is reduced. The radiation pattern in the forward direction of the short-range communication antenna element 80 is improved in this respect, too.

Figure 8:
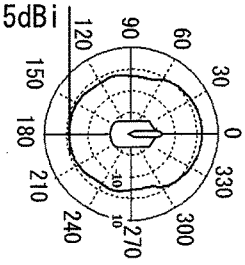
FIG. 8 is a diagram showing the directivities of the short-range communication antenna elements of the first and second embodiments in comparison.
Figure 8:
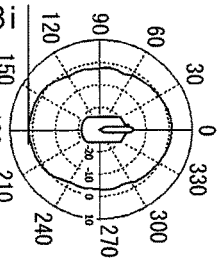

FIG. 8 shows the directivities of the short-range communication antenna elements 80 of the first and second embodiments. The left side of FIG. 8 shows the directivity of the short-range communication antenna element 80 of the first embodiment, i.e., the directivity of the short-range communication antenna element 80 when the distal end of the mobile network antenna element 50 is located at a height higher than the feed point 70 of the short-range communication antenna element 80. The right side of FIG. 8 shows the directivity of the short-range communication antenna element 80 of the second embodiment, i.e., the directivity of the short-range communication antenna element 80 when the distal end of the mobile network antenna element 150 is positioned below the feed point 70 of the short-range communication antenna element 80. FIG. 8 shows the directivities of the collective antenna devices 1 and 100 when the collective antenna devices 1 and 100 are placed on a horizontal plane.

As can be seen from FIG. 8, the gain in the forward direction, i.e., in the 180° direction, of the short-range communication antenna element 80 of the first embodiment is about −1.5 dBi, while the forward gain of the short-range communication antenna element 80 of the second embodiment is about 1.4 dBi. Therefore, the forward gain of the second embodiment is higher by about 2.9 dB than the forward gain of the first embodiment.

(Third Embodiment)

Figure 9:
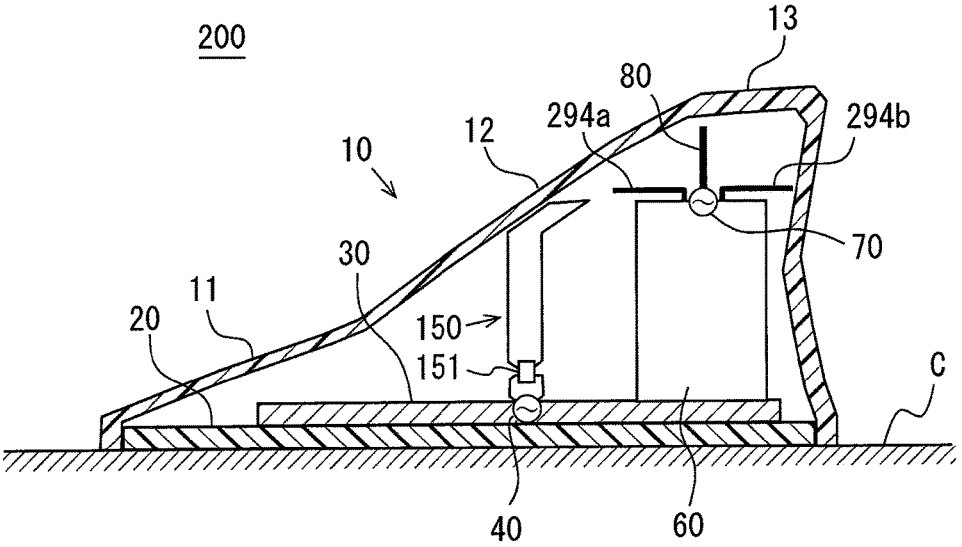
FIG. 9 is a cross-sectional view of a collective antenna device of a third embodiment.

As shown in FIG. 9, a collective antenna device 200 of a third embodiment includes two counterpoises 294*a* and 294*b* arranged on the upper end of the substrate 60. These counterpoises 294*a* and 294*b* are bar-like members and arranged substantially parallel to the upper side of the quadrate substrate 60, in other words, substantially parallel to the front-back direction of the case 10. Since the counterpoises 294*a* and 294*b* are substantially parallel to the front-back direction of the case 10, the counterpoises 294*a* and 294*b* are approximately perpendicular to the short-range communication antenna element 80.

The two counterpoises 294*a* and 294*b* both have their bases bent approximately at right angles to the parts that are substantially parallel to the front-back direction of the substrate 60. The distal ends of the base sides are connected to a ground pattern (not shown) on the substrate 60 at positions adjacent to the feed point 70. The distance at which the distal ends of the base sides adjoins the feed point 70 may be changed suitably within a range in which the counterpoises 294*a* and 294*b* can function as the grounds of the short-range communication antenna element 80.

The counterpoises 294*a* and 294*b* are made of a conductive material such as copper and have a length of λ/4, which is the length that enables the counterpoises 294*a* and 294*b* to function favorably.

Because of the presence of the counterpoises 294*a* and 294*b*, the ground height is the height where the counterpoises 294*a* and 294*b* are arranged. Therefore, the ground is located above the ground plate 30.

Without the counterpoises 294*a* and 294*b*, the ground pattern between the feed point 70 and the ground plate 30 behaves like an antenna element, which, in combination with the short-range communication antenna element 80 located on the feed point 70, results in a dipole antenna-like structure. Consequently, unnecessary radiation occurs from the ground pattern between the feed point 70 and the ground plate 30.

In contrast, in this embodiment, since the ground height is the height where the counterpoises 294*a* and 294*b* are arranged, the unnecessary radiation from the ground pattern formed on the substrate 60 is reduced. By the reduction in unnecessary radiation, the overall power gain in the horizontal plane of the short-range communication antenna element 80 that is located above the feed point 70 is better than a case where the counterpoises 294*a* and 294*b* are not provided. Therefore, the radiation pattern in the forward direction of this short-range communication antenna element 80 is improved, too.

In addition, with the ground being located at the height where the counterpoises 294*a* and 294*b* are arranged, coupling with the mobile network antenna element 50 that is present in front of the short-range communication antenna element 80 is also reduced. The radiation pattern in the forward direction of the short-range communication antenna element 80 is improved in this respect, too.

(Fourth Embodiment)

Figure 10:
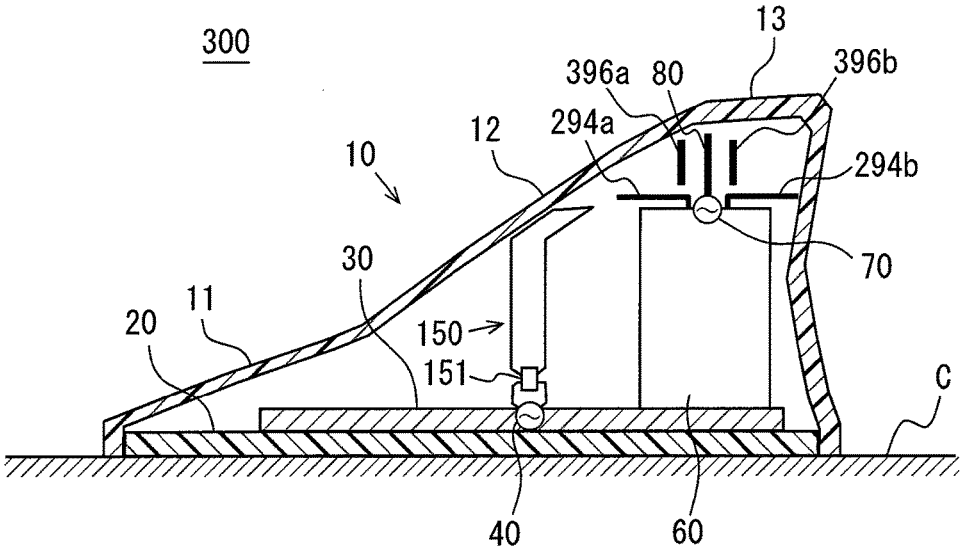
FIG. 10 is a cross-sectional view of a collective antenna device of a fourth embodiment.

A collective antenna device 300 of a fourth embodiment includes all the elements of the collective antenna device 200 of the third embodiment, as shown in FIG. 10. The collective antenna device 300 of the fourth embodiment further includes conductive parasitic elements 396*a* and 396*b* substantially parallel to the short-range communication antenna element 80 in the front and back of the short-range communication antenna element 80 in the vehicle longitudinal direction. These parasitic elements 396*a* and 396*b* are positioned opposite to the short-range communication antenna element 80 in the up-and-down direction, i.e., above the feed point 70.

These parasitic elements 396*a* and 396*b* can be fixed inside the case 10 by, for example, firmly attaching a non-conductive rod perpendicularly to the short-range communication antenna element 80 at a predetermined position on the short-range communication antenna element 80 and by fixing the parasitic elements 396*a* and 396*b* to this rod.

The parasitic elements 396*a* and 396*b* function as a waveguide device or reflector. The parasitic elements 396*a* and 396*b* can have various lengths and be positioned at various distances from the short-range communication antenna element 80 as well known in order to function as a waveguide device or reflector.

Just to give one example, the parasitic elements 396*a* and 396*b* may be at a distance of λ/4 from the short-range communication antenna element 80 and may have a length slightly shorter than λ/2 so as to function as a waveguide device. To function as a reflector, the parasitic elements 396*a* and 396*b* may be distanced from the short-range communication antenna element 80 similarly to when functioning as a waveguide device, and may have a length slightly longer than λ/2. Alternatively, when functioning as a waveguide device or as a reflector, the distance may be made shorter than λ/4, and the length of the parasitic elements 396*a* and 396*b* may be reduced by the amount by which the distance is reduced.

The parasitic element 396*a* on the front side may function as a waveguide device while the parasitic element 396*b* on the rear side may function as a reflector. Conversely, the parasitic element 396*a* on the front side may function as a reflector while the parasitic element 396*b* on the rear side may function as a waveguide device. In these cases, single directivity toward the waveguide device can be achieved. Alternatively, both parasitic elements 396*a* and 396*b* may be made to function as a waveguide device. This way, the power gain in the forward and backward directions of the vehicle is improved.

Since the collective antenna device 300 of the fourth embodiment includes parasitic elements 396*a* and 396*b* that function as a waveguide device or reflector, the short-range communication antenna element 80 is highly directional toward a position where the parasitic elements 396*a* and 396*b* are present. The parasitic elements 396*a* and 396*b* are located above the feed point 70. Therefore, in comparison to the case where these parasitic elements 396*a* and 396*b* are not provided, the short-range communication antenna element 80 is directed upward because of the parasitic elements 396*a* and 396*b*.

When the feed point 70 of the short-range communication antenna element 80 is positioned above the ground plate 30, there is a risk that the gain may reduce in some directions due to interference between the radio waves emitted from the short-range communication antenna element 80 and reflected on the vehicle surface and the radio waves traveling straight from the short-range communication antenna element 80.

In this embodiment, however, since the parasitic elements 396*a* and 396*b* that function as a waveguide device or reflector are provided and the antenna is directed more upward than when the parasitic elements 396*a* and 396*b* are not provided, radio waves reflected on the vehicle surface are reduced. As the radio waves are less reflected on the vehicle surface, there is less interference between the radio waves traveling straight from the short-range communication antenna element 80 and the radio waves reflected on the vehicle surface, and thus a reduction in the gain can be minimized.

While embodiments of the present disclosure have been described above, the present disclosure is not limited to the embodiments described above and its technical scope includes the following variation examples. The disclosure can be embodied with various changes other than those described below without departing from the scope of the subject matter.

(First Variation Example)

For example, while the distal end of the short-range communication antenna element 80 is positioned at a height higher than the distal end of the mobile network antenna element 50 or 150 in the first to fourth embodiments described above, the structure is not limited to the above-described structure. As long as the feed point 70 is positioned above the ground plate 30, the short-range communication antenna element 80 can have a higher power gain in the forward direction than when the feed point 70 is on the ground plate 30. Therefore, as long as the feed point 70 is positioned above the ground plate 30, the feed point 70 may be positioned below the feed point 70 in the embodiments described above, so that the distal end of the short-range communication antenna element 80 is positioned below the distal end of the mobile network antenna element 50 or 150.

Note, however, the configuration in which the distal end of the short-range communication antenna element 80 is positioned at a height higher than the distal end of the mobile network antenna element 50 or 150 is impossible if the positions of the short-range communication antenna element 80 and the mobile network antenna element 50 or 150 are swapped. In other words, the configuration in which the distal end of the short-range communication antenna element 80 is positioned at a height higher than the distal end of the mobile network antenna element 50 or 150 makes efficient use of the arrangement in which the short-range communication antenna element 80 is positioned further behind in the case 10 than the mobile network antenna element 50 or 150.

(Second Variation Example)

The short-range communication antenna element 80 may not necessarily be straight, and may be helical at the tip, or bent midway.

(Third Variation Example)

While the two counterpoises 294*a* and 294*b* are provided substantially parallel in the front-back direction of the case 10 in the third embodiment, the structure is not limited to the above-described structure. There may be more than two counterpoises, i.e., two more counterpoises may be added such as to extend from near the feed point 70 and cross the two counterpoises 294*a* and 294*b* at right angles. Alternatively, there may be only one counterpoise, although the effects by the counterpoise are then reduced. While the angle of the counterpoises in the up-and-down direction is preferably perpendicular to the short-range communication antenna element 80 as in the embodiments described above, this angle need not be perpendicular to achieve the effects of the counterpoises to some extent. Therefore, the angle of the counterpoises in the up-and-down direction may not be perpendicular to the short-range communication antenna element 80.

(Fourth Variation Example)

In the embodiments described above, the short-range communication antenna element 80 that transmits and receives radio waves of a frequency of 5.9 GHz corresponds to the second antenna element, while the mobile network antenna element 50 or 150 that transmits and receives radio waves of a frequency band of 700 MHz to 900 MHz corresponds to the first antenna element. The frequencies of radio waves transmitted and received by the first antenna element and second antenna element are not limited to these, as long as the second frequency transmitted and received by the second antenna element is above the first frequency transmitted and received by the first antenna element. As one example, an antenna element that transmits and receives radio waves of 2.4 to 2.5 GHz, 5.15 to 5.35 GHz, and 5.47 to 5.725 GHz that are used in IEEE802.11 may be used as the second antenna element. An antenna element that transmits and receives radio waves of 1.5 GHz or 1.7 GHz band, which is higher than the 700 MHz to 900 MHz band, may be used as the first antenna element.

(Fifth Variation Example)

In the fourth embodiment, one each parasitic element that functions as a waveguide device or reflector is arranged in the front and back of the short-range communication antenna element 80, but the number of parasitic elements is not limited to this. One parasitic element may be arranged only in front of, or in the back of the short-range communication antenna element 80. Alternatively, a plurality of parasitic elements may be arranged in front of, or in the back of the short-range communication antenna element 80.

(Sixth Variation Example)

While the case 10 in the above-described embodiments is shaped to include the first gradually rising part 11 and the second gradually rising part 12 which have different slopes, and a rear part 13 with a substantially constant internal spatial height, the case shape is not limited to this. The case may have a shape in which the internal spatial height in the rear part decreases toward the rear end as in Patent Literature 1. Alternatively, the case may have a shape in which the internal spatial height increases continuously from the front end to the rear end.

(Seventh Variation Example)

The counterpoises 294*a* and 294*b*, antenna elements 50, 80, and 150, and parasitic elements 396*a* and 396*b* may be configured as a conductive pattern on the substrate 60.

(Eighth Variation Example)

Figure 11:
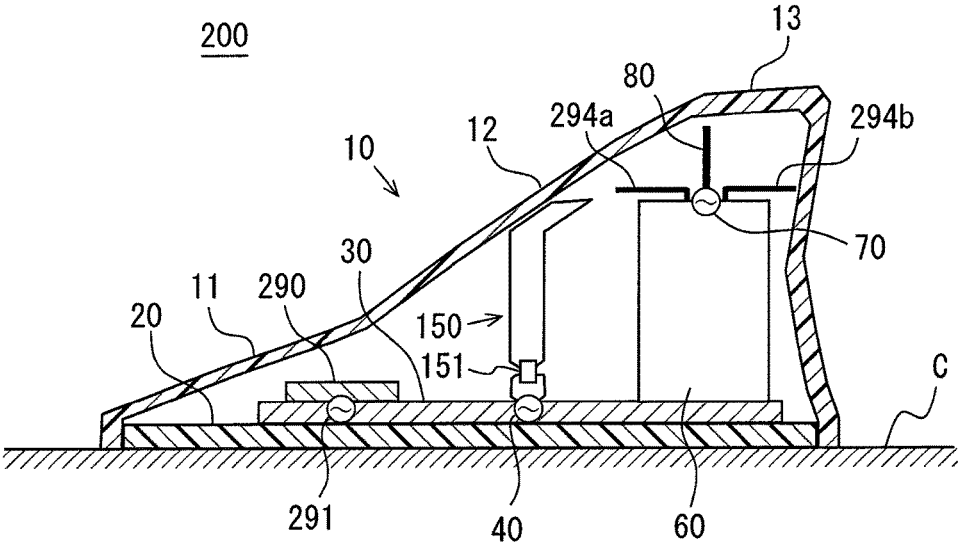
FIG. 11 is a cross-sectional view of an eighth variation example of the collective antenna device.

As shown in FIG. 11, as a variation example of the third embodiment, the collective antenna device 200 may include, at the front end of the ground plate 30 in the front-back direction of the vehicle, a GNSS antenna 290 used in a global navigation satellite system (GNSS), and a feed point 291 connected to this GNSS antenna 290. Although not shown, the GNSS antenna 290 and feed point 291 may be provided at the position indicated in FIG. 11 also in the collective antenna devices 1, 100, and 300 of the first, second, and fourth embodiments.

What is claimed is:

1. A collective antenna device comprising:

a case including a gradually rising part in which spatial height increases continuously toward a rear part;

a ground plate that is accommodated in a bottom part of the case;

a first antenna element that is accommodated in the case and configured for a first frequency; and a second antenna element that is accommodated in the case and configured for a second frequency higher than the first frequency, wherein:

the second antenna element is accommodated at the gradually rising part or behind the gradually rising part in the case as well as behind the first antenna element in the case;

the second antenna element has a feed point located above the ground plate;

the feed point of the second antenna element is set at a position such that a distal end of the second antenna element is located at a height higher than a distal end of the first antenna element; and the feed point of the second antenna element is located at the same height as the distal end of the first antenna element, or is located at a height higher than the distal end of the first antenna element.

2. The collective antenna device according to claim 1, wherein the first antenna element is arranged in the gradually rising part and inclined backward along an inclination of the gradually rising part.

3. The collective antenna device according to claim 1, further comprising a counterpoise, wherein:

an antenna including the second antenna element and a ground is an unbalanced antenna; and the counterpoise is arranged adjacent to the feed point of the second antenna element.

4. The collective antenna device according to claim 1, further comprising: a parasitic element that functions as a waveguide device or reflector, wherein: an antenna including the second antenna element and a ground is an unbalanced antenna; and the parasitic element is arranged on at least one of front and back sides of the second antenna element and above the feed point.

5. The collective antenna device according to claim 3, wherein the unbalanced antenna is a monopole antenna.

6. The collective antenna device according to claim 1, wherein the first antenna element and the second antenna element are monopole antennas, and are arranged to be perpendicular to the ground plate.

7. The collective antenna device according to claim 1, wherein the first antenna element receives or transmits a radio wave in a frequency band, which is in a range from 700 MHz to 1.7 GHz.

8. The collective antenna device according to claim 1, wherein the second antenna element receives or transmits a radio wave in a frequency band, which is higher than or equal to 2.4 GHz.

9. The collective antenna device according to claim 1, wherein the first antenna element has a feed point located at a center of the ground plate in a vehicle front-back direction below the gradually rising part.

* * * * *